United States Patent [19]

Shindo et al.

[11] Patent Number: 4,731,298

[45] Date of Patent: Mar. 15, 1988

[54] CARBON FIBER-REINFORCED LIGHT METAL COMPOSITES

[75] Inventors: Akio Shindo, Kawanishi; Kuniaki Honjo, Ikeda, both of Japan

[73] Assignees: Agency of Industrial Science & Technology; Ministry of Industrial Trade & Industry, both of Tokyo, Japan

[21] Appl. No.: 775,397

[22] Filed: Sep. 12, 1985

[30] Foreign Application Priority Data

Sep. 14, 1984 [JP] Japan ..... 59-193469

[51] Int. Cl.[4] ..... B32B 15/14

[52] U.S. Cl. ..... 428/611; 428/614

[58] Field of Search ..... 428/614, 621, 634, 627, 428/608, 611; 164/97

[56] References Cited

U.S. PATENT DOCUMENTS

| | | | |
|---|---|---|---|
| 3,427,120 | 2/1969 | Shindo et al. | 423/447.6 |
| 3,860,443 | 1/1975 | Lachman et al. | 428/614 |
| 3,886,263 | 5/1975 | Shindo et al. | 423/447.6 |
| 3,888,661 | 6/1975 | Levitt | 428/634 |
| 4,223,075 | 9/1980 | Harrigan et al. | 428/634 |
| 4,341,823 | 7/1982 | Sexton et al. | 428/614 |

FOREIGN PATENT DOCUMENTS

| | | | |
|---|---|---|---|
| 51-81703 | 7/1976 | Japan . | |
| 52-7811 | 1/1977 | Japan | 428/614 |
| 53-38791 | 4/1978 | Japan | 428/634 |
| 57-82570 | 5/1982 | Japan . | |
| 144441 | 8/1983 | Japan | 164/97 |

*Primary Examiner*—John J. Zimmerman

*Attorney, Agent, or Firm*—Oblon, Fisher, Spivak, McClelland & Maier

[57] ABSTRACT

Carbon fiber-reinforced light metal composites comprising a light metal and carbon fiber having a three layer-coating, i.e. a layer of carbon, a protective layer against deteriorative reaction, and a wettability-improving layer superposed outwardly in the order mentioned, are provided. The carbon fiber-reinforced light metal composites are manufactured by binding carbon fibers having the aforementioned three layer-coating with a light metal.

14 Claims, No Drawings

CARBON FIBER-REINFORCED LIGHT METAL COMPOSITES

BACKGROUND OF THE INVENTION

1. Field of the Invention

This invention relates to carbon fiber-reinforced light metal composites, i.e. carbon fibers bound with aluminum or aluminum alloy (hereinafter referred to collectively as "aluminum metal") or magnesium or magnesium alloy (hereinafter referred to collectively as "magnesium metal).

2. Discussion of the Background

The aluminum metal or magnesium metal containing carbon fibers are generally designated as carbon fiber-light metal composites or carbon fiber-reinforced light metals. As a light weight structural material possessing higher heat resistance than carbon fiber reinforced plastic (CFRP), the carbon fiber-reinforced light metals have been the subject of research devoted to development of applications in various industrial fields, typically the aerospace industry. Carbon fibers, however, are not readily wetted with the molten light metals aforementioned. When the carbon fiber-reinforced light metal is to be produced by a molten metal impregnation method, therefore, the carbon fibers are required to be covered with a coating which is readily wettable with the molten light metal. As a material for such a coating, a titanium-boron intermetallic compound has been known to the art (Japanese Patent Public Disclosure No. SHO 51(1976)-81703), but the observed values of the strength of aluminum metal or magnesium metal composites reinforced with carbon fibers coated with a thin layer of the titanium-boron intermetallic compound are considerably lower than the theoretical value based on the rule-of-mixtures. Such a deterioration is more remarkable for the carbon fibers produced at a temperature below about 1500° C. than for the fibers produced at a higher temperature. This deterioration is due to the occurrence of reaction of the carbon fibers with such a metal. Since the Ti-B coating has little effect for protecting the carbon fiber from the reaction, more improved coatings are desired to be developed.

SUMMARY OF THE INVENTION

An object of the present invention is therefore to provide carbon fiber-reinforced aluminum metal composites or magnesium metal composites, without deterioration of the properties of either the fibers or the metal.

Another object of this invention is to provide a method for the production of the aforementioned carbon fiber-reinforced light metal composites.

To accomplish the objects described above, the carbon fiber-reinforced light metal composites of the present invention comprise at least one light metal selected from the group consisting of aluminum, aluminum alloy, magnesium, and magnesium alloy and a carbon fiber having a three layer-coating consisting of a first layer composed of carbon at least 95% by weight, a layer composed of at least one compound selected from the group consisting of metal carbides, titanium nitride, and boron nitride, and a layer composed preponderantly of at least one compound selected from the group consisting of titanium-boron, boron, and silicon-boron, superposed on individual filaments of the carbon fiber, outwardly in the order mentioned. The method of this invention for the production of the aforementioned carbon fiber-reinforced light metal composites comprises coating individual filaments of the carbon fiber by superposing a first layer composed of at least 95% by weight of carbon, a layer composed preponderantly of at least one compound selected from the group consisting of metal carbides, titanium nitride, and boron nitride, and a layer composed preponderantly of at least one compound selected from the group consisting of titanium-boron, boron, and silicon-boron outwardly in the order mentioned, and bonding the so-coated fiber having three layer-coating with at least one light metal selected from the group consisting of aluminum, aluminum alloy, magnesium, and magnesium alloy.

DESCRIPTION OF THE PREFERRED EMBODIMENT

For the production of the carbon fiber-reinforced light metal composites, it is a prerequisite that the carbon fibers can be wetted with the molten metal. The carbon fibers, therefore, are desired to be coated with a wettability-improving layer. The conventional wettability-improving layer, however, has no effect on the protection of the carbon fibers from the deterioration reaction. Accordingly, it is desirable for the carbon fibers to be coated with a layer having the capability to prevent the deterioration reaction before they are coated with the aforementioned wettability-improving layer. With this in mind, the inventors conducted various investigations and found that when the carbon fibers are coated with a metal carbide as a deterioration reaction-preventing material, this coating causes a large reduction in strength of the carbon fibers. This is presumed to owe to the fact that when the fibers are stretched, the coating first sustains rupture and this rupture induces, the carbon fibers to undergo breakage. After a further study, the inventors found that when the carbon fibers are coated with a layer of carbon in advance of the coating with the reaction-preventing layer, the large reduction in strength mentioned above can be precluded.

They have consequently confirmed that the product aimed at by the present invention can be obtained by coating carbon fibers first with a layer of carbon, then thereon with a reaction-preventing layer, and further thereon with a wettability-improving layer, and infiltrating the interstices among the filaments of the obtained carbon fibers coated with such a three-layer-coating with aluminum metal or magnesium metal. This invention is based on this knowledge.

The aforementioned layer for the prevention of deteriorative reaction is formed of a metal carbide, titanium nitride, and/or boron nitride. Examples of the metal carbide usable advantageously herein include the carbides of silicon, boron, titanium, zirconium, tungsten, niobium and tantalum. The wettability-improving layer is formed of a titanium-boron compound or mixture, boron, or a boron-silicon compound or mixture. Each of these three layers may be formed of a single substance or a mixture of two or more substances, and may be composed of two or more sublayers having different compositions and structures. The carbon fibers used in this invention may be made from any of precursors such as PAN (polyacrylonitrile), rayon, mesophase pitch or the like. These carbon fibers may be in the form of yarns, tows or webs of continuous filaments. The carbon fibers may be used in the form of yarn and webs of short fibers or the like.

The formation of the first layer of carbon as a mechanical-deterioration-preventing film on the carbon fibers can be effected by any of the methods known to the art (such as the method disclosed in Japanese Patent Public Disclosure No. SHO 57(1982)-82570). This method comprises keeping carbon fibers heated in a reaction chamber insulated from air, feeding the gas of a compound containing carbon atoms in the chamber, and bringing the gas into contact with the carbon fibers heated at a temperature in the range of 750° to 2,000° C. Examples of this compound include propane, methane, benzene, and numerous other hydrocarbons, and halogen-substituted hydrocarbon. These compounds may be used either singly or in the form of a mixture of two or more species. The concentration of the gas can be adjusted by diluting it with inert gas and/or hydrogen. The coating of carbon is desired to have a smooth surface conforming to the surface contour of the underlying carbon fiber filaments, and to have the so-called lamellar structure wherein the basal planes of a graphite crystallite run parallel to the surface of the carbon fiber filaments. Such a coating can be formed with ease by the method described above. The coating layer is desired to contain at least 95% of carbon (free carbon) because at below 95% of carbon the coating cannot sufficiently prevent the strength reduction by the superposed layers. The thickness of the coating of carbon is required to be at least 0.001 μm. When the thickness of this coating is more than 2.0 μm is disadvantageously becomes difficult to superpose successive layers. The coating of the deterioration-reaction-preventing layer is advantageously effected by the deposition of the compound from a gaseous phase. For this purpose, the chemical vapor deposition (CVD) method disclosed in Japanese Patent Public Disclosure No. SHO 58(1983)-31167 can be adopted. This method comprises bringing a mixed gas consisting of the halogenide of such a metal as described above, a hydrocarbon or a halogen-substituted hydrocarbon such as, for example, propane, butane, carbon tetrachloride, chloroform, or dichloroethylene, hydrogen and/or an inert gas into contact with the aforementioned carbon-coated carbon fibers at a temperature in the range of 1,000° to 1,700° C. The formation of a coating of silicon carbide can be effected by introducing $CH_3SiCl_3$ or $(CH_3)_2SiCl_2$ on the carbon-coated carbon fibers at a temperature in the range of 1,000° to 1,700° C.

The coating of titanium nitride can be formed by using, for example, a mixed gas consisting of titanium tetrachloride, nitrogen, and hydrogen. The boron nitride coating can be formed by introducing, for example, a mixed gas consisting of boron trifluoride and ammonia into the chamber of the carbon-coated carbon fibers at a temperature in the range of 1,000° to 1,500° C. the thickness of the coating is in the range of 2 to 0.001 μm. The coating containing two or more metals can also be obtained by using a mixed gas of two or more metal-containing compounds. Further, this layer may consist of two or more substances selected from a group of metal carbides, titanium nitride or boron nitride.

On this layer-coating is further superposed a wettability-improving coating.

For the formation of this wettability-improving coating, the method for deposition from a gaseous phase is recommended. To be specific, the coating of titanium-boron composition can be effected by using the method disclosed in Japanese Patent Public Disclosure No. SHO 51(1976)-81703. This method specifically comprises reducing a mixed gas of titanium tetrachloride and boron trichloride with zinc vapor in the chamber in which the carbon fibers coated with the first and second layers beforehand are held. In the coating process of the wettability-improving layer, the boron coating process can also be adopted, in which boron trichloride gas is reduced with zinc metal vapor on the carbon fibers. The boron-silicon coating can also be used as a wettability-improving coating, the process of which comprises reducing a mixture of boron trichloride and silicone tetrachloride with zinc vapor on the carbon fiber filaments at elevated temperatures. In either of the aforementioned cases, the concentration of the metal halogenide in the coating gas can be adjusted with an inert gas or hydrogen or both. The temperature of the coating treatment is in the range of 500° to 900° C. The thickness of this coating is in the range of 2 to 0.001 μm. The combined thickness of the first, second and third layers desirably falls in the range of 3 to 0.003 μm.

If the combined thickness exceeds the upper limit of the aforementioned range, the carbon fibers are deprived of flexibility and ease of handling. If it is less than the lower limit, the three-layer-coating is not so effective as desired.

To bond the carbon fibers furnished with the three layer-coating as described above with a light metal, any of various methods can be adopted. Particularly, the method which comprises impregnating the aggregate of carbon fibers with the melt of the light metal is recommended. In this case, the carbon fibers on which the third wettability-improving coating has been freshly superposed are desired to be immersed in the melt of the light metal before they are exposed to any oxidative atmosphere. In this manner, the melt of the light metal is enabled to permeate the aggregate of carbon fibers under atmospheric pressure, namely without requiring application of pressure. The aforementioned bonding may otherwise be accomplished by vacuum depositing the light metal on the coated carbon fibers and piling a plurality of such aggregates of the so-metal-deposited carbon fibers one on top of another. The bonding may also be accomplished by piling aggregates of the three-layer-coated carbon fibers with foils or powders of the light metal and then subjecting the resultant pile to application of heat and pressure.

The light metals usable in the present invention include aluminum, magnesium and various alloys containing these metals as main components. These alloys may be selected, though not exclusively, from the aluminum and magnesium alloys specified by JIS and ASTM. The additive components may be silicone, magnesium, copper, manganese and others for the aluminum alloys and aluminum, zinc, manganese, silicon, copper, nickel and others for the magnesium alloys. Although the amount of aluminum or magnesium in the respective alloys is not specifically defined, it is generally desired to exceed 70% by weight.

Both the kind of the carbon fibers and the kind of the coating are widely variable. Thus, the general characteristics of the carbon fiber-reinforced light metal composites are difficult to depict precisely.

From the typical experiment cited below, however, it may be understood that the carbon fibers-reinforced light metal composites of the present invention posses excellent qualities.

EXPERIMENT

Wires of carbon fiber unidirectionally reinforced light metal were fabricated and tested for strength to examine the effect of coating. In the case of PAN-based carbon fibers, the fibers coated only with a Ti-B (wettability-improving) layer of 0.03 μm in thickness were found to show strength of about 30% of the value (140 kgf/mm$^2$) expected from the rule-of-mixtures, those coated with a silicone carbide (deteriorative reaction-preventing) layer of 0.2 μm in thickness and a Ti-B (wettability-improving) layer to show strength of about 50% of the value, and those with a three-layer coating produced by the method of this invention using a first layer of carbon 0.1 μm in thickness, a second deteriorative reaction-preventing layer 0.15 μm in thickness, and a third wettability-improving layer 0.1 μm in thickness to show strength of more than 70%, at times more than 85%, of the rule-of-mixture value. The numerical values indicated above are based on the tensile strength of the original carbon fibers without coatings.

The value expected from the rule-of-mixtures, $\sigma_c$(ROM), is calculated by the following formula.

$$\sigma_c(\mathrm{ROM})=\sigma_m(1-V_f)+\sigma_f V_f$$

wherein $\sigma_f$ and $\sigma_m$ stand for the strengths of carbon fiber and metal matrix, respectively, and $V_f$ for the volumetric content of fibers. The changes in strength by heat treatment of the wires at 300° and 400° C. were compared between the coated carbon fiber of the present invention and the carbon fiber coated with a wettability-improving layer or the carbon fiber coated with a carbon layer alone. This comparison indicated that the wire with the three-layer-coated fiber exhibited a potably higher level of resistance to thermal deterioration than the others.

Consequently, the present invention provides higher-strength, more highly thermally stable metal matrix composites in which higher strength carbon fibers produced at a carbonizing stage, a temperature around 1000°-1,700° C., as reinforcements. The present invention also provides high reinforcement efficiency and markedly higher thermal stability than those provided by the prior art on the metal matrix composites in which high modulus carbon fibers produced at a graphitizing stage, a temperature higher than around 1,700° C., is used as reinforcement.

Now, the present invention will be described below with reference to working examples.

EXAMPLE 1

A PAN-based carbon fiber yard (consisting of 3,000 filaments with filament diameter of 8 μm and a strength of 310 kgf/mm$^2$) was exposed to a flowing gas containing 0.2% of propane in Ar, and then at 1,200° C. to a flowing gas containing $CH_3SiCl_3$, $H_2$ and Ar in volumetric proportions of 2, 20 and 250. Subsequently, this yarn was sequentially passed at 700° C. through a flow of mixture of gas or vapor consisting of $BCl_3$, $TiCl_4$, Ar, and Zn in respective amounts of 1.4, 2.0, and 230 ml/min and 20 mg/min and at 730° C. through a metal of aluminum alloy 6061. Consequently, there are obtained a wire of carbon fiber-reinforced aluminum alloy. It contained fibers at 385 by volume. The obtained wire showed a strength of 85% (105 kgf/mm$^2$) of the ROM value. The first, second, and third coatings were 0.05, 0.2, and 0.05 μm in thickness, respectively.

EXAMPLE 2

A PAN-based carbon fiber yarn produced at a carbonizing stage (consisting of 6,000 filaments with a filament diameter of 7 μm and a strength of 440 kgf/mm$^2$) was continuously heated at 1,300° C. in a flow of argon containing 0.3% of methane and at 1,100° C. in a flow of mixed gas containing $TiCl_4$, methane, hydrogen and argon in proportions of 0.5, 0.6, 9 and 90%, to have a layer of carbon (0.05 μm in thickness) and a layer of titanium carbide (0.3 μm in thickness) deposited on the individual filaments. The yarn was then passed through a flow of mixed gas containing $BCl_3$, $SiCl_4$ and Ar in a volumetric ratio of 1:3:100 to form a coating of silicon-boron composition (0.1 μm in thickness). It was subsequently passed through a melt of magnesium alloy ZA61A at 700° C. Consequently, there was obtained a wire containing 32% by volume of fibers. The wire showed a tensile strength of 79% (115 kgf/mm$^2$) of the value based on the rule-of-mixture (ROM).

EXAMPLE 3

A PAN-based carbon fiber yarn produced at a graphitizing stage (consisting of 3,000 filaments with a filament diameter of 8 μm and a strength 210 kgf/mm$^2$) was heated at 1,300° C. in an Ar gas containing 0.3% of propane to form a coating of carbon (0.05 μm in thickness) thereon. Then, the yarn was heated at 1,200° C. in a mixed gas containing $TiCl_4$, $N_2$, $H_2$ and Ar in volumetric proportions of 0.5, 3, 1.5, and 90% to form a coating of TiN (0.6 μm in thickness) thereon. The yarn obtained consequently was coated with a Ti-B layer of 0.05 μm in thickness on every filament by the same procedure as in Example 1. The yarn was further passed at 720° C. through the melt of Al alloy. Consequently, there was obtained a wire containing 32% by volume of fibers and having a strength of 84% (60 kgf/mm$^2$) of the ROM value.

EXAMPLE 4

Mesophase pitch-based carbon fiber yarn (consisting of 2,000 filaments, fiber diameter of 10 μm and a strength of 250 kgf/mm$^2$) was coated with a layer of carbon (0.1 μm in thickness). Subsequently, the yarn was passed through a flow of mixed gas containing $BF_3$, $NH_3$, $H_2$ and Ar in volumetric proportions of 0.4, 0.4, 0.2 and 995 to form a coating of BN (0.3 μm in thickness) on the individual filaments. The fibers were coated with a layer of B-Si (0.1 μm in thickness), and then passed through the melt of Al alloy. Consequently, there was obtained a wire reinforced with high efficiency.

EXAMPLE 5

A rayon-based carbon fiber yarn (Thornel 25) was coated with a layer of carbon (0.05 μm in thickness) by following the procedure of Example 1. Then, the yarn was heated at 1,200° C. in a gas flow consisting of $BCl_3$, propane, $H_2$ and Ar to form a coating of boron carbide (0.4 μm in thickness) on the individual filaments. It was further passed through a flow of mixed gas of $BCl_3$ and Zn to form a coating of boron (0.03 μm in thickness) thereon, and then passed through the melt of Al alloy. Consequently, there was obtained a wire reinforced with sufficiently high efficiency.

COMPARATIVE EXPERIMENT 1

The same carbon fibers as used in Example 1 were treated by following the procedure of Example 1, except that the step of forming a layer of carbon from propane was omitted. The coated carbon fibers were then passed through the melt of aluminum alloy. Consequently, there was obtained a wire containing 42% by volume of fibers. The strength of this wire was 25% (21 kgf/mm$^2$) of the ROM value.

COMPARATIVE EXPERIMENT 2

The same carbon fibers as used in Example 2 were treated by following the procedure of Example 2, except that the step of forming layer of titanium carbide was omitted. The coated carbon fibers were passed through the melt of aluminum. Consequently, there was obtained a wire containing 35% by volume of fibers. The strength of this wire was 50% (79 kgf/mm$^2$) of the ROM value.

What is claimed is:

1. A carbon fiber-reinforced light metal composite, comprising at least one light metal selected from the group consisting of aluminum alloy, magnesium and magnesium alloy, and carbon fibers having a layer formed of at least 95% by weight of free carbon, a layer formed preponderantly of at least one compound selected from the group consisting of metal carbides, titanium nitride, and boron nitride, and a layer formed preponderantly of at least one compound selected from the group consisting of titanium-boron, boron, and silicon-boron superposed on said carbon fibers outwardly in the order mentioned.

2. A carbon fiber-reinforced light metal composite according to claim 1, wherein said metal carbide is a carbide of at least one metal selected from the group consisting of silicon, boron, titanium, zirconium, tungsten, niobium, and tantalum.

3. A carbon fiber-reinforced light metal composite according to claim 1, wherein each of said three layers possesses a thickness in the range of 2 to 0.001 μm.

4. A carbon fiber-reinforced light metal composite according to claim 1, wherein the combined thickness of said three layer is in the range of 3 to 0.003 M.

5. A carbon fiber-reinforced light metal composite according to claim 1, wherein said carbon fibers are carbon fibers produced by being heat-treated at a temperature of at least 1,000° C.

6. A carbon fiber-reinforced light metal composite, comprising (1) coated carbon fibers embedded in (2) a light metal matrix, wherein:

the said coated carbon fibers each comprise a carbon fiber core coated with three successive layers, wherein the first of the said layers comprises at least 95% by weight free carbon, the second of the said layers is made of at least one member selected form the group consisting of metal carbides, titanium nitride and boron nitride, and the third of the said layers is made of at least one member selected from the group consisting of titanium-boron, boron and silicon-boron compounds; wherein the said layers extend outwardly from the said carbon fiber in the order: first layer, second layer, third layer, and wherein the said light metal is at least one member selected from the group consisting of aluminum, aluminum alloys, magnesium and magnesium alloys.

7. The carbon fiber-reinforced light metal composite of claim 6, wherein the said metal carbide is at least one member selected from the group consisting of silicon carbide, boron carbide, titanium carbide, zirconium carbide, tungsten carbide, niobium carbide and tantalum carbide.

8. The carbon fiber-reinforced light metal composite of claim 6, wherein each of the said three layers has a thickness of 2 to 0.001 μm.

9. The carbon fiber-reinforced light metal composite of claim 6, wherein the said three layers have a combined thickness of 3 to 0.003 μm.

10. The carbon fiber-reinforced light metal composite of claim 6, wherein the said carbon fibers are carbon fibers produced by heat-treatment at a temperature of at least 1,000° C.

11. The carbon fiber-reinforced light metal composite of claim 6, wherein the said light metal is aluminum.

12. The carbon fiber-reinforced light metal composite of claim 6, wherein the said light metal is an aluminum alloy.

13. The carbon fiber-reinforced light metal composite of claim 6, wherein the said light metal is magnesium.

14. The carbon fiber-reinforced light metal composite of claim 6, wherein the said light metal is a magnesium alloy.

* * * * *